US007340850B2

(12) United States Patent
Lin et al.

(10) Patent No.: US 7,340,850 B2
(45) Date of Patent: Mar. 11, 2008

(54) VENTILLATING STRUCTURE FOR FOOTWEAR

(75) Inventors: Hsi-Liang Lin, No. 152, Sec. 1, Chi Lung Rd., Taipei (TW); Ming-Hsiung Lin, No. 152, Sec. 1, Chi Lung Rd., Taipei (TW)

(73) Assignees: Hsi-Liang Lin, Taipei (TW); Ming-Hsiung Lin, Taipei (TW); Chao-Yung Chan, Taipei (TW)

( * ) Notice: Subject to any disclaimer, the term of this patent is extended or adjusted under 35 U.S.C. 154(b) by 325 days.

(21) Appl. No.: 11/246,051

(22) Filed: Oct. 11, 2005

(65) Prior Publication Data

US 2007/0000148 A1 Jan. 4, 2007

(30) Foreign Application Priority Data

Jun. 29, 2005 (TW) ..... 94210890 U

(51) Int. Cl.
*A43B 7/06* (2006.01)

(52) U.S. Cl. ..... 36/3 R; 36/3 B; 36/29

(58) Field of Classification Search ..... 36/3 R, 36/3 B, 25 R, 30 R, 28, 29
See application file for complete search history.

(56) References Cited

U.S. PATENT DOCUMENTS 568,068 A * 6/1896 Hilgert ..... 36/3 R
1,010,002 A * 11/1911 Steen ..... 36/3 R
1,809,323 A * 6/1931 Wiliams, Sr. ..... 36/3 R
2,003,646 A * 6/1935 De Blasio ..... 36/3 R
3,331,146 A * 7/1967 Elias ..... 36/3 B
5,299,368 A * 4/1994 Liu ..... 36/3 B
5,701,687 A * 12/1997 Schmidt et al. ..... 36/29
6,477,792 B2 * 11/2002 Sartor ..... 36/44
6,581,303 B1 * 6/2003 Tuan ..... 36/3 B
6,948,260 B2 * 9/2005 Lin et al. ..... 36/3 B
2001/0016991 A1 * 8/2001 Sartor ..... 36/3 B

* cited by examiner

*Primary Examiner*—Marie Patterson
(74) *Attorney, Agent, or Firm*—Leong C. Lei

(57) ABSTRACT

A ventilating structure for a shoe is provided, which contains a duct member containing a number of air ducts communicating with a plurality of through holes at the sole's rim, a first pad member having a plurality of through holes on top of the duct member, a semi-spherical bubble member fixedly attached to the top of the first pad member covering at least a through hole of the first pad member directly above an air duct of the duct member, and a second pad member on top of the first pad member having a number of through holes and a bulged section accommodating the bubble member. As a user walks on a shoe of the invention, the bubble member, like a pump, undergoes intermittent compressions and releases by the user's foot, causing warm and humid air to be expelled out or fresh air to be drawn inside of the shoe quickly and periodically.

2 Claims, 2 Drawing Sheets

VENTILLATING STRUCTURE FOR FOOTWEAR

BACKGROUND OF THE INVENTION (a) Technical Field of the Invention

The present invention generally relates to footwear, and more particularly to a ventilating structure for shoes.

(b) Description of the Prior Art

When people wear their shoes for an extended period of time, the high temperature from body heat and the humidity developed inside the shoes often cause un-comfortableness to the users. Sometimes the unpleasant odor even makes people embarrassed when they take their shoes off in front of other people.

Therefore, a large number of techniques have been disclosed in the prior art for improving the ventilation of the shoes' air-tight space. Most of the techniques involve use some ventilating mechanism such as through holes configured on the face or the sole of the shoes, and/or the use of some specially designed materials for air flow in and out of the shoes.

In general, these techniques are effective but only to a certain extent in that most of the techniques rely on the small gaps between a user's foot and the shoe for air exchange between the inside and outside of the shoes. As the user's feet block most of the air flow, the removal of the high temperature and humidity inside the shoes is not speedy enough to achieve a cool and dry environment for the user's feet.

SUMMARY OF THE INVENTION

The primary purpose of the present invention is to provide a ventilating structure for a shoe, which allows fast and periodical air exchange as people walk. The present invention contains a duct member containing a number of air ducts communicating with a plurality of through holes at the sole's rim, a first pad member having a plurality of through holes on top of the duct member, a semi-spherical bubble member fixedly attached to the top of the first pad member covering at least a through hole of the first pad member directly above an air duct of the duct member, and a second pad member on top of the first pad member having a number of through holes and a bulged section accommodating the bubble member. As a user walks on a shoe of the present invention, the bubble member undergoes intermittent compressions and releases, causing warm and humid air to be expelled out or fresh air to be drawn inside of the shoe periodically.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
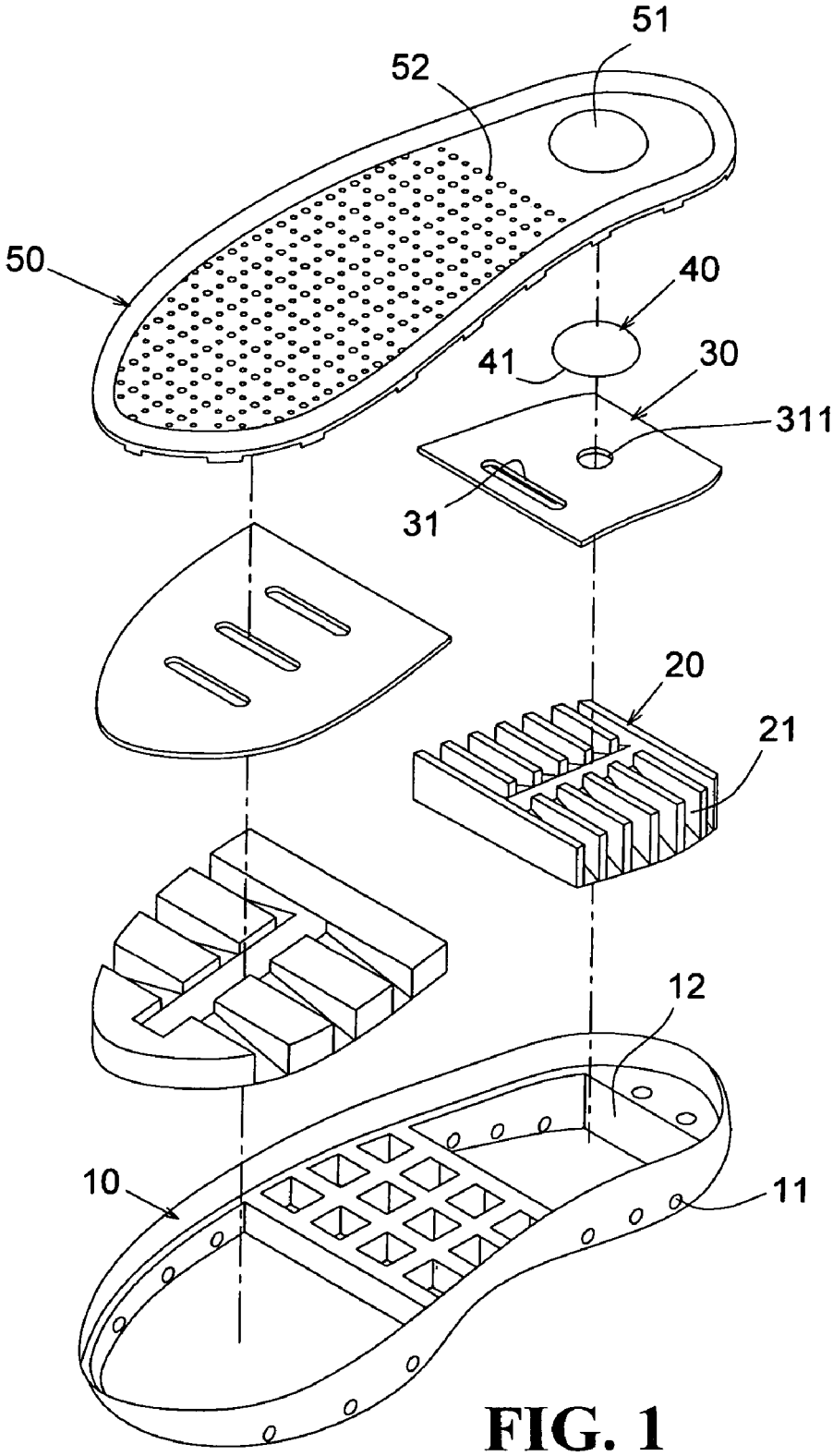
FIG. 1 is a perspective view showing the various components of the ventilating structure according to an embodiment of the present invention.
Figure 2:
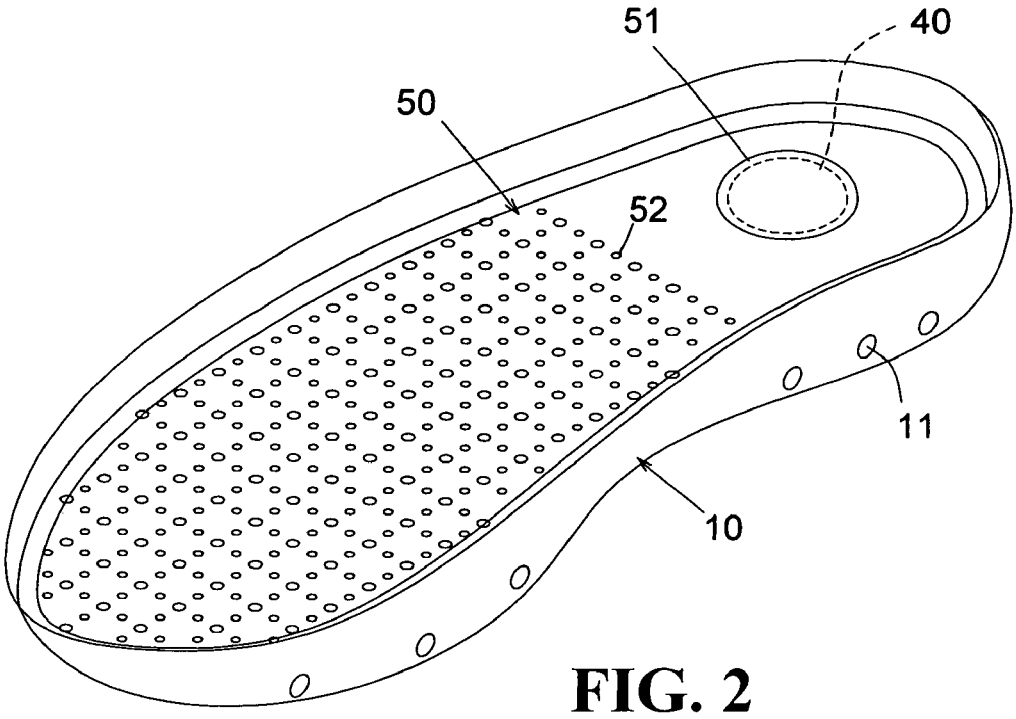
FIG. 2 is a perspective view showing the ventilating structure of FIG. 1 after it is assembled.
Figure 3:
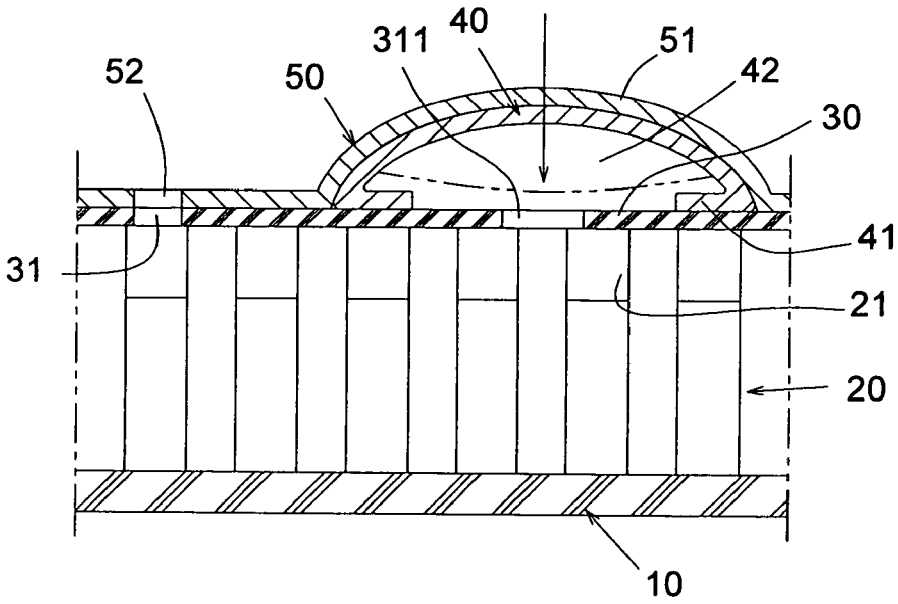
FIG. 3 is a schematic sectional view showing the ventilating structure of FIG. 1.

As shown in FIGS. 1~3, the ventilating structure according to an embodiment of the present invention mainly contains a duct member 20 which is embedded inside the sole 10 of a shoe. The duct member 20 contains a number of intercommunicating air ducts 21 which allow air to circulate through a number through holes 11 at the rim of the sole 10. The duct member 20 is integrated with the sole 10 by installing the duct member 20 inside a seat 12 having a matching shape and dimension as the duct member 20. In some other embodiments, the duct member 20 and the sole 10 could be molded into a single object, instead of being two separate elements as in the present embodiment.

The ventilating structure further contains a first pad member 30 positioned on top of the duct member 20, which is configured with a number of through holes 31. On top of the first pad member 30, a bubble member 40, which is a semi-sphere, has its circular bottom 41 fixedly attached by adhesive, thermal pressing, or any appropriate means to the first pad member 30. Please note that the bubble member 40 is configured such that it covers at least a through hole 311 of the first pad member 30 which is directly above an air duct 21 of the duct member 20.

The ventilating structure further contains a second pad member 50 located on top of the first pad member 40. The second pad member 50 has a number of through holes 52 and a bulged section 51 whose location, shape, and dimension match those of the bubble member 40 so that the bubbler member 40 is perfectly housed inside the bulge section 51 of the second pad member 50.

As the bubble member 40 covers at least a through hole 311 directly above an air duct 21, as illustrated in FIG. 3, a hollow chamber 42 defined by the bubble member 40 and the first pad member 30 communicates with at least an air duct 21. As such, when a user is walking on a shoe according to the present invention, the bubble member 40 is compressed to the imaginary dashed line shown in FIG. 3 and the air in the hollow chamber 41 is expelled to outside of the shoe via the through holes 311 of the first pad member 30, the air ducts 21 of the duct member 20, and the through holes 11 of the sole 10. In addition, as the bubble member 40 is compressed, some air is forced to flow upward into the shoe via the other through holes 31 of the first pad member 30 and the through holes 52 of the second pad member 50.

As the user lifts up his or her foot, the resilient bubble member 40 flexibly restores to its original shape automatically, resulting in a vacuumed hollow chamber 42. The outside greater atmospheric pressure forces fresh air to flow from the outside into the shoe via the through holes 11 of the sole 10, the air ducts 21 of the duct member 20, and the through holes 31 of the first pad member 30.

As the user walks, the bubble member 40 undergoes intermittent compressions and releases by the user's foot, causing warm and humid air to be expelled out or fresh air to be drawn inside of the shoe quickly and periodically. The present invention thereby achieves the constant and speedy ventilation of the shoe. Please note that the present invention could be applied to all kinds of footwear such as leather shoes, athletic shoes, etc. and is not confined to any specific type of shoes.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A ventilating structure of a shoe comprising:

a duct member embedded inside a sole of said shoe comprising a plurality of intercommunicating air ducts, said air ducts communicating with a plurality of through holes at the rim of said sole;

a first pad member on top of said duct member having a plurality of through holes;

a bubble member being a semi-sphere fixedly attached to a top surface of said first pad member covering at least a through hole of said first pad member directly above an air duct of said duct member; and a second pad member on top of said first pad member having a plurality of through holes and a matching bulged section accommodating, said bubble member.

2. The ventilating structure according to claim 1, wherein said duct member and said sole are molded into a single object.

* * * * *